US006682145B2

(12) United States Patent
Wilkerson et al.

(10) Patent No.: US 6,682,145 B2
(45) Date of Patent: Jan. 27, 2004

(54) INFLATABLE LUMBAR SUPPORT

(75) Inventors: Larry A. Wilkerson, Comstock Park, MI (US); Thomas M. Perrin, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 10/222,951

(22) Filed: Aug. 16, 2002

(65) Prior Publication Data

US 2003/0075960 A1 Apr. 24, 2003

Related U.S. Application Data

(63) Continuation of application No. 09/591,156, filed on Jun. 9, 2000, now abandoned.

(51) Int. Cl.[7] ..... A47C 7/46; B60N 2/22
(52) U.S. Cl. ..... 297/284.6; 297/452.41
(58) Field of Search ..... 297/284.6, 284.3, 297/452.41

(56) References Cited

U.S. PATENT DOCUMENTS 3,661,422 A * 5/1972 Sember et al. ..... 297/284.6
3,974,827 A * 8/1976 Bodeen ..... 606/237
4,444,430 A * 4/1984 Yoshida et al. ..... 297/284.6
4,516,568 A * 5/1985 Baxter et al. ..... 606/237
4,518,200 A * 5/1985 Armstrong ..... 297/284.6
4,749,230 A * 6/1988 Tornero ..... 297/353
4,807,931 A * 2/1989 Ishida et al. ..... 297/284.6
5,076,643 A * 12/1991 Colasanti et al. ..... 297/284.6
5,314,235 A * 5/1994 Johnson ..... 297/284.5
5,372,487 A * 12/1994 Pekar ..... 417/480
5,660,438 A * 8/1997 Tedesco ..... 297/284.6
5,711,575 A * 1/1998 Hand et al. ..... 297/284.6
5,758,925 A * 6/1998 Schrewe et al. ..... 297/284.6
5,810,439 A * 9/1998 Roslund, Jr. ..... 297/300.4
5,902,011 A * 5/1999 Hand et al. ..... 297/284.6
5,951,107 A * 9/1999 Tornero ..... 297/353
6,220,663 B1 * 4/2001 Benden et al. ..... 297/284.6 X

* cited by examiner

*Primary Examiner*—Anthony D Barfield
(74) *Attorney, Agent, or Firm*—Flynn, Thiel, Boutell & Tanis, P.C.

(57) ABSTRACT

An inflatable lumbar support arrangement includes a pump unit for selectively inflating a bladder whereby the bladder is located in the lumbar region of the backrest. The pump unit is connected to the bladder and includes a pump and a release valve. The pump unit further includes a single actuator handle which projects sidewardly from below the seat and is movable vertically in opposite directions. The actuator handle operatively cooperates with both the pump and the release valve which are thereby operated by movement of the actuator handle in the opposite directions. As such, the pump is operated to inflate the bladder by repetitive movement of the actuator handle in one direction, while the release valve is opened by movement of the actuator handle in the opposite direction.

23 Claims, 9 Drawing Sheets

INFLATABLE LUMBAR SUPPORT

This is a continuation of Ser. No. 09/591,156, filed Jun. 9, 2000 now abandoned.

FIELD OF THE INVENTION

The invention relates to an office chair having an inflatable bladder therein, and more particularly, to an inflatable lumbar support arrangement for the office chair wherein the bladder is located in the lumbar region of the chair back.

BACKGROUND OF THE INVENTION

In conventional office chairs having a seat and back rest, it is known to provide bladder arrangements therein wherein the bladder is located in the seat or back rest. The bladder is connected to a manually-operable pump and therefore is inflatable to improve the comfort of an occupant. The bladder typically is supported between an inner plastic shell for the seat or back rest and a cushion which mounts to the shell. The bladder is connected to the pump, and also is connected to a release valve which is selectively opened to reduce or vent completely the fluid pressure in the bladder.

In known chairs, various types of pumps have been used to inflate the bladder. For example, bladder pumps on office chairs have included squeeze bulbs and pushbutton pumps which pumps are mounted to the back rest or seat so as to be accessible by hand. In some of these chairs, the pumps are fully exposed which can be unsightly. In other chairs, the pumps are more discreetly positioned on the chair although this can make it more difficult for the occupant to locate the pump and adjust the pressure in the bladder.

Additionally, the pump and the release valve are separate mechanisms which are manually actuated independently of each other by respective actuation buttons and the like. As such, these prior bladder arrangements can be more difficult to operate since the occupant must first locate the pump for inflating the bladder and then reposition their hand to locate the release valve and reduce the bladder pressure.

Examples of office chairs having inflatable bladder arrangements are disclosed in U.S. Pat. Nos. 575,895, 711, 575, 5,660,438 and 4,444,430.

It therefore is an object of the invention to provide an improved inflatable bladder support arrangement which overcomes or reduces the disadvantages associated with known bladder arrangements used in chairs.

The invention relates to an inflatable lumbar support arrangement wherein a bladder is located in the lumbar region of a back assembly, although it will be understood that the bladder may also be positioned in the seat of the chair or a chair arm supported on the back assembly or a seat assembly.

The lumbar support arrangement includes a pump unit which pump unit is connected to the bladder and includes a pump and a release valve. The pump unit of the invention includes a single actuator handle which projects sidewardly from below the seat and has an appearance similar to actuator handles used to operate other mechanisms such as a tilt lock mechanism. Thus, the actuator handle has a more aesthetically pleasing appearance.

The actuator handle cooperates with both the pump and the release valve whereby manual movement of the actuator handle in a first direction through a pump stroke effects pumping of the pump to inflate the bladder, while movement of the actuator handle in a second direction through a release stroke opens the release valve to release or vent pressure from the bladder. Accordingly, a single actuator handle is provided which performs dual-functions so as to simplify usage of the lumbar support arrangement.

The pump unit preferably is located below the seat near a rear edge thereof to further simplify usage of the pump unit. In particular, the actuator handle extends sidewardly from below the seat such that the occupant can more readily locate the actuator handle by reaching downwardly. Further, the actuator handle preferably is moved vertically upwardly and/or downwardly which is a more natural, ergonomic movement for the occupant. This arrangement as described in more detail herein is believed to overcome many of the disadvantages associated with known bladder arrangements.

Although a particular embodiment of the invention has been disclosed in detail for illustrative purposes, it will be recognized that variations or modifications of the disclosed apparatus, including the rearrangement of parts, lie within the scope of the present invention.

Figure 1:
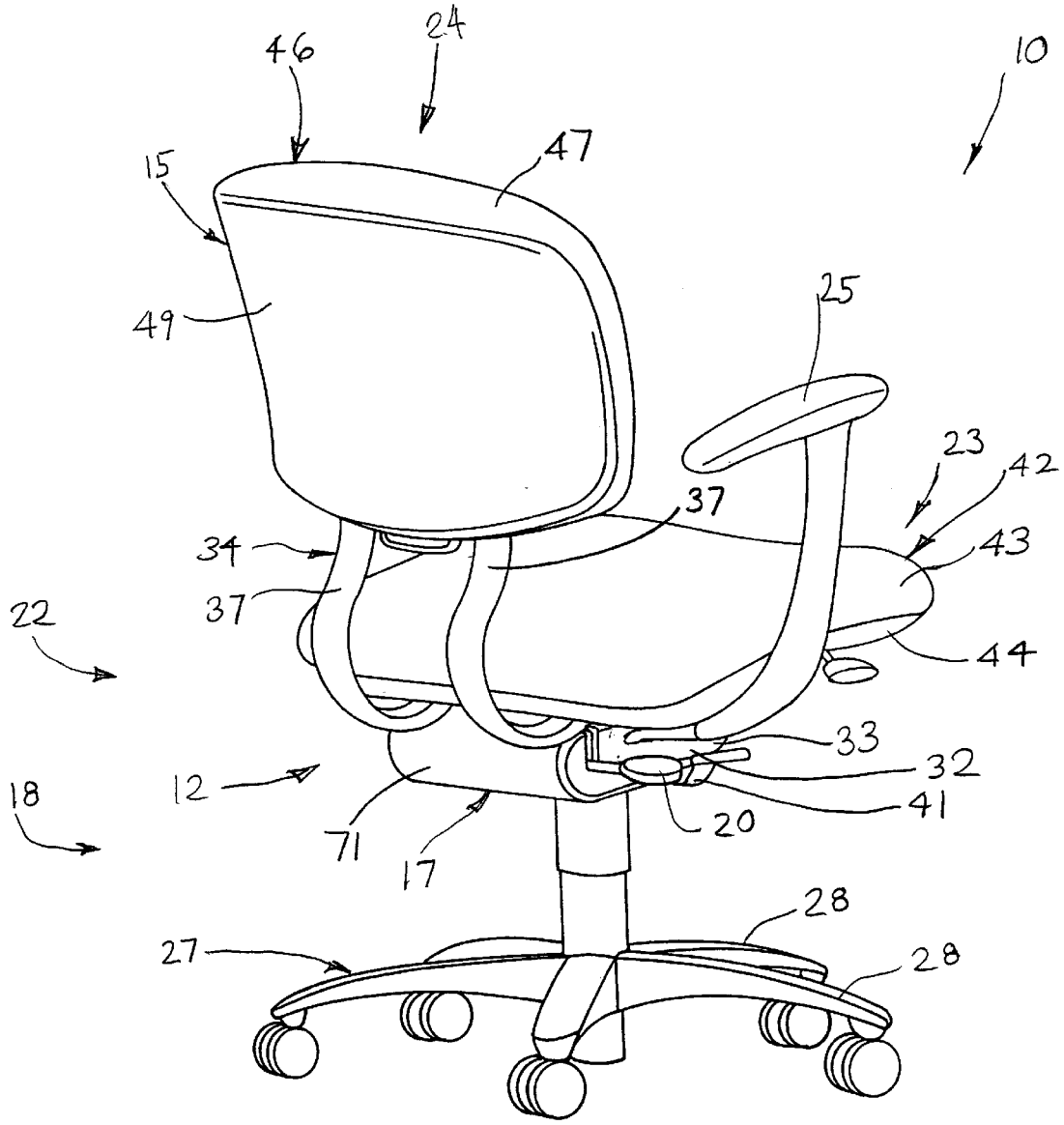
FIG. 1 is a rear perspective view of an office chair having the inflatable lumbar support arrangement of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Figure 5:
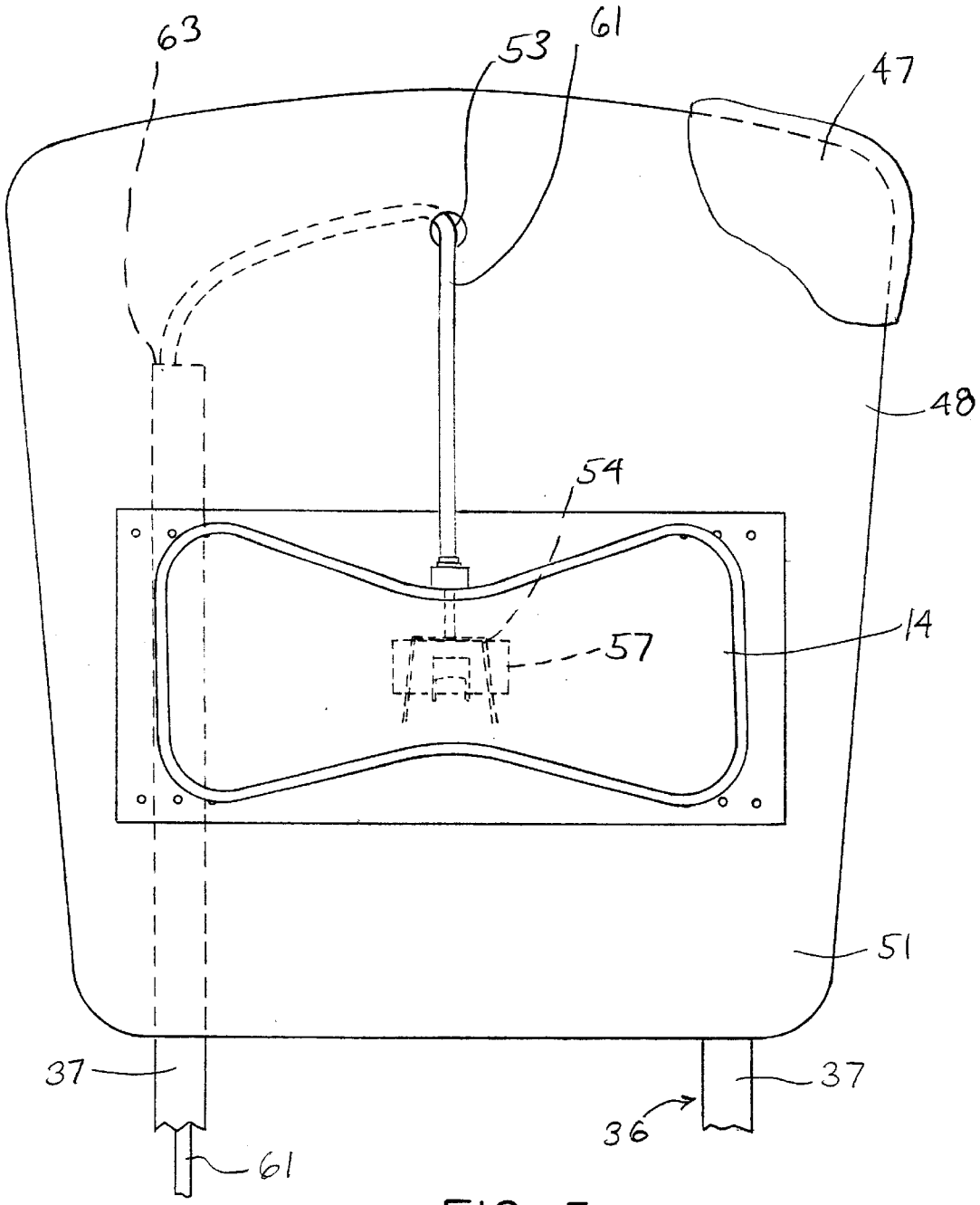
FIG. 5 is a front elevational view of the inner shell having an inflatable bladder supported on the front face thereof.

Referring to FIG. 1, the invention relates to an office chair 10 having an inflatable bladder arrangement 12. The inflatable bladder arrangement 12 includes an inflatable bladder 14 which is illustrated in FIG. 5 mounted to a back rest 15 of the chair 10. The inflatable bladder arrangement 12 further includes a pump unit 17 which is supported on a base 18 of the chair 10 and is operatively connected to the bladder 14 for inflation thereof.

Generally in operation, the pump unit 17 includes an actuator handle 20 which is manually movable to operate the pump unit 17. As described in further detail herein, the actuator handle 20 is repeatedly moved vertically through a pump stroke to inflate the bladder 14 and is moved downwardly through a release stroke to deflate the bladder 14.

The chair 10 to which the inflatable bladder arrangement 12 is mounted, is conventional in that the chair 10 includes a generally L-shaped seat-back arrangement 22. The seat-back arrangement 22 includes a seat assembly 23 and a back assembly 24 wherein the seat assembly 12 includes a pair of chair arms 25 which are connected to and supported thereby.

The seat-back arrangement 22 is supported on the chair base 18 which base 18 includes a height-adjustable pedestal 27 that projects upwardly. The pedestal 27 has the upper end thereof interconnected to the seat assembly 23 substantially at the middle thereof, and the lower end of the pedestal 27 includes multiple legs 28 radiating outwardly therefrom.

The seat-back arrangement 22, and its connection to the pedestal 27, includes a chair tilt control mechanism 32. The tilt control mechanism 32 includes two primary components of which are a control body 33 which is fixed to an upper end of the pedestal 27, and an upright 34 extending upwardly from a rear edge of the seat assembly 23. The upright 34 is a generally L-shaped structure having a generally horizontal connector plate 36 at the lower end thereof and a pair of generally vertical legs 37 which are supported on the connector plate 36 by elbows or curved portions 38.

Figure 2:
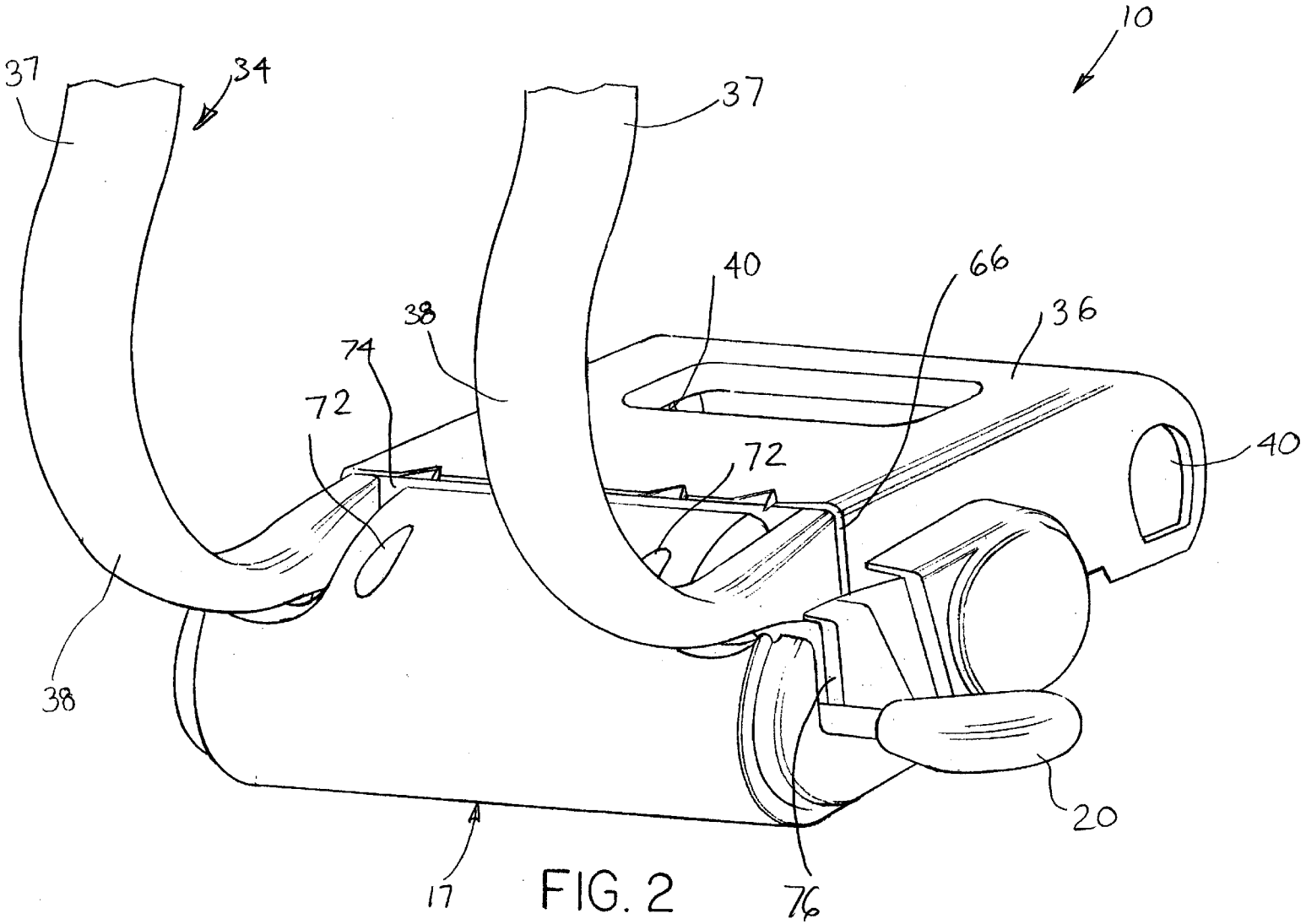
FIG. 2 is an enlarged rear perspective view of a chair upright and a pump unit of the inflatable lumbar support arrangement.

Referring to FIGS. 1 and 2, the lower connector plate 36 projects under the seat assembly 23 and has pin openings 40 near the front free end thereof which pivotally connect the upright 34 to the control body 33. The upper ends of the legs 37 of the upright 34 support the back assembly 24 thereon, and the tilt control mechanism 32 further includes a spring arrangement within the control body 33 which normally resiliently urges the upright 34 into an upright position as illustrated in FIG. 1 but permits rearward tilting of the seat-back arrangement 22. The tilt control mechanism 32 also includes one or more handles 41 which operate the features of the tilt control mechanism 32 such as a tilt lock.

More particularly with respect to the seat assembly 23 and the back assembly 24, the seat assembly 23 includes a seat member or chair pad 42 which is formed by an upholstered cushion 43 that is secured to the upper surface of a horizontally enlarged support shell or plate 44. The support shell 44 is supported on the tilt control mechanism 32.

Referring to FIGS. 1 and 5, the back assembly 24 includes a back member or vertical chair pad 46 which has an upholstered back cushion 47 that is secured to the front side of a vertically enlarged inner support shell or plate 48. The inner support shell 48 is secured to the upright 34 wherein the opposite back side of the inner support shell 48 is covered by a rigid back cover 49 (FIG. 1).

The chair 10 and the above described components thereof are disclosed in further detail in U.S. Pat. No. 5,810,439, which patent is owned by the assignee of the present invention. The disclosure of U.S. Pat. No. 5,810,439 is incorporated herein by reference in its entirety.

The following is a more detailed disclosure as to the inflatable bladder arrangement 12 and its connection to and operation with the chair 10.

In the present invention, the bladder 14 is disposed within the back member 46, although it is known to provide bladders within the seat of a chair and thus, it will be understood that the bladder 14 may be disposed within the seat member 42.

The bladder 14 is supported on the front face 51 of the inner support shell 48, while the inner support shell 48 is supported on the laterally spaced apart vertical legs 37 of the upright 36. The inner support shell 48 further includes connector apertures 52, to which the back cover 49 is connected by fasteners, and an upper aperture 53 disposed centrally between the apertures 52.

To support the bladder 14 thereon, a cantilevered support tab 54 is provided in the central region of the inner support shell 48 wherein the edges of the support tab 54 are separated from the remainder of the shell 48 by an inverted U-shaped gap 56. The support tab 54 extends upwardly and is located so that the bladder 14 when mounted thereto is positioned in the lumbar region of the chair occupant.

The bladder 14 is a generally flat, hollow enclosure having a mounting band or strap 57 on the back face thereof which extends laterally or sidewardly and is adapted to receive the support tab 54 vertically therethrough. The support tab 54 thereby supports the bladder 14 on the front face of the inner support shell 48, which bladder 14 is covered by the back cushion 47 that holds the bladder 14 flat against the front shell face 51.

The bladder 14 is commercially available and is formed of a flexible resilient material which may be inflated by a pressurized fluid, and then deflated to a flat condition upon a release of the fluid. The bladder 14 further includes a fluid line connector 60 which projects vertically and defines a passage that opens into the interior of the bladder 14. The fluid line connector 60 permits the bi-directional passage of a fluid therethrough, which fluid preferably is air.

The inflatable bladder arrangement 12 further includes a fluid line 61 which is formed of flexible tubing and has one end connected to the fluid line connector 60. The fluid line 61 extends upwardly from the bladder 14 along the front face 51 of the inner support shell 48 and passes rearwardly through the upper aperture 53.

The upright 34 is formed of hollow tubing, such that the legs 37 and elbows 38 thereof define hollow passages along their entire length through which the fluid line 61 is routed. In particular, at least one of the legs 37 has an upper opening 63 at the upper end thereof, whereby the fluid line 61 extends sidewardly from the upper aperture 53 along the back face of the inner support shell 48 and then downwardly into the upper opening 63. The fluid line 61 continues downwardly through the upright 34 and exits forwardly through a lower opening 66 defined at the front end or mouth of the elbow 38 near the connector plate 39. The fluid line 61 has a lower end 68 which then extends rearwardly into a hollow interior 69 of the pump unit 17 and operatively connects to and communicates with the pump unit 17 as described in further detail hereinafter.

Figure 3:
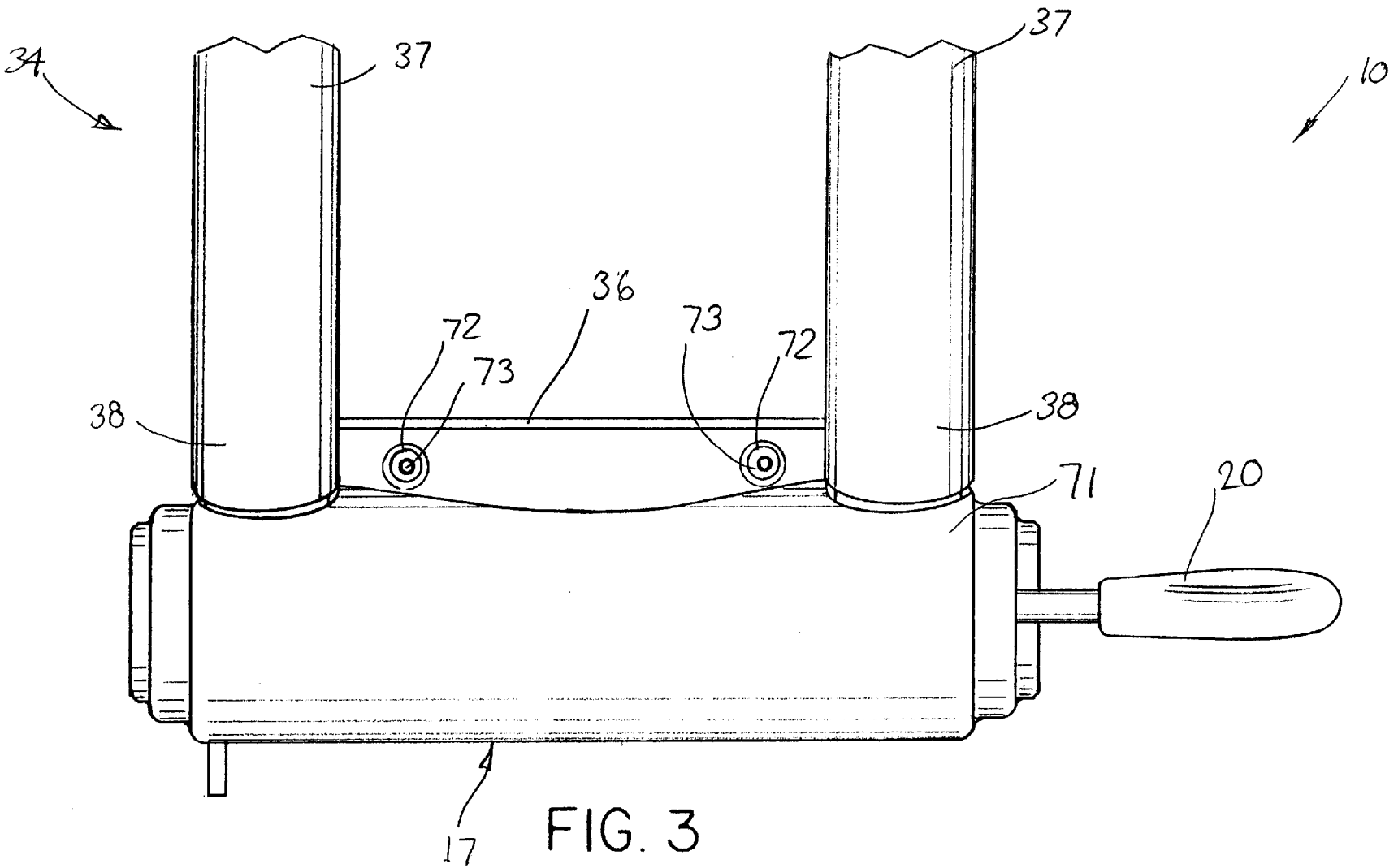
FIG. 3 is a rear elevational view of the upright and pump unit of FIG. 2.
Figure 4:
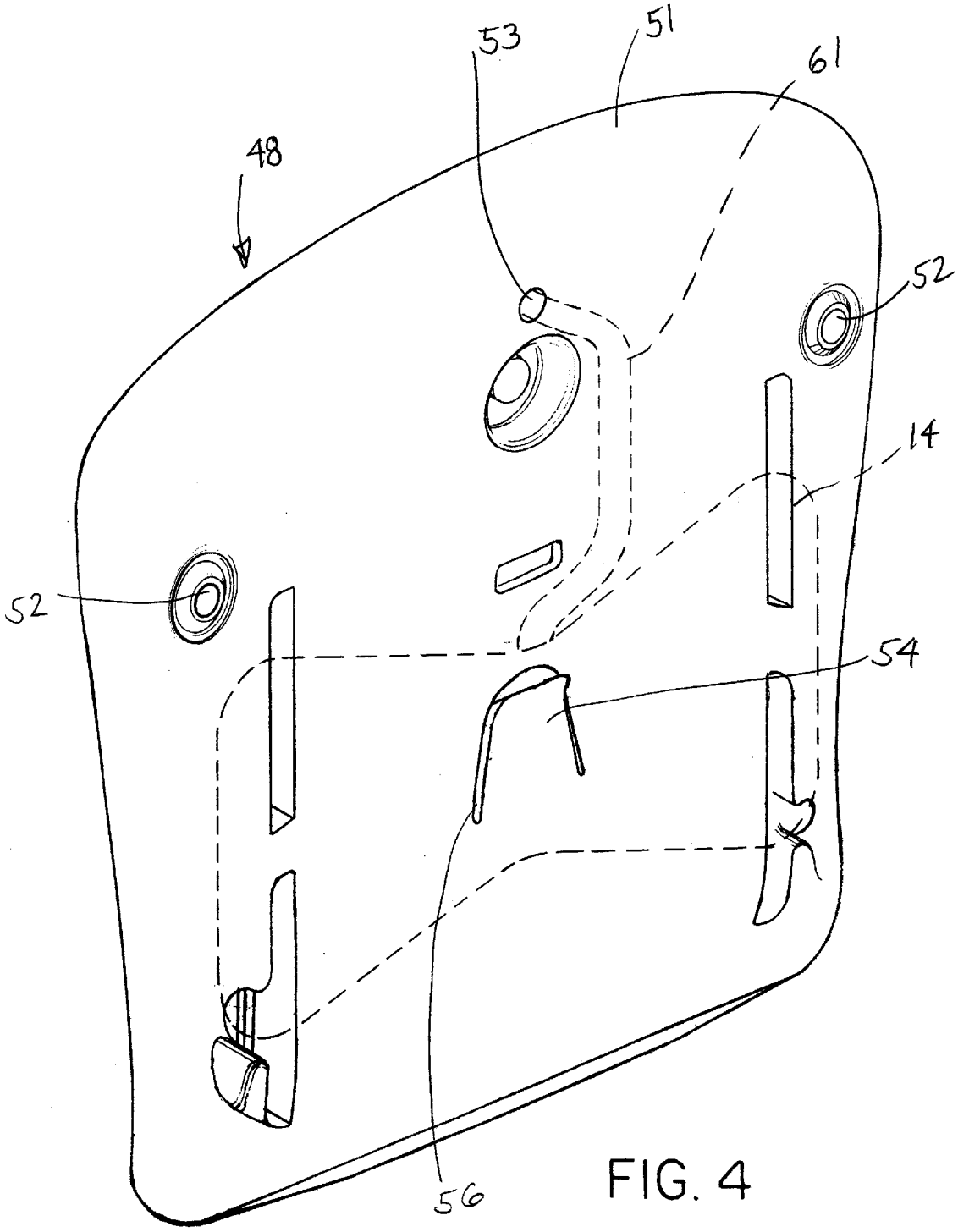
FIG. 4 is a front perspective view of an inner shell of the back rest of the chair.
Figure 7:
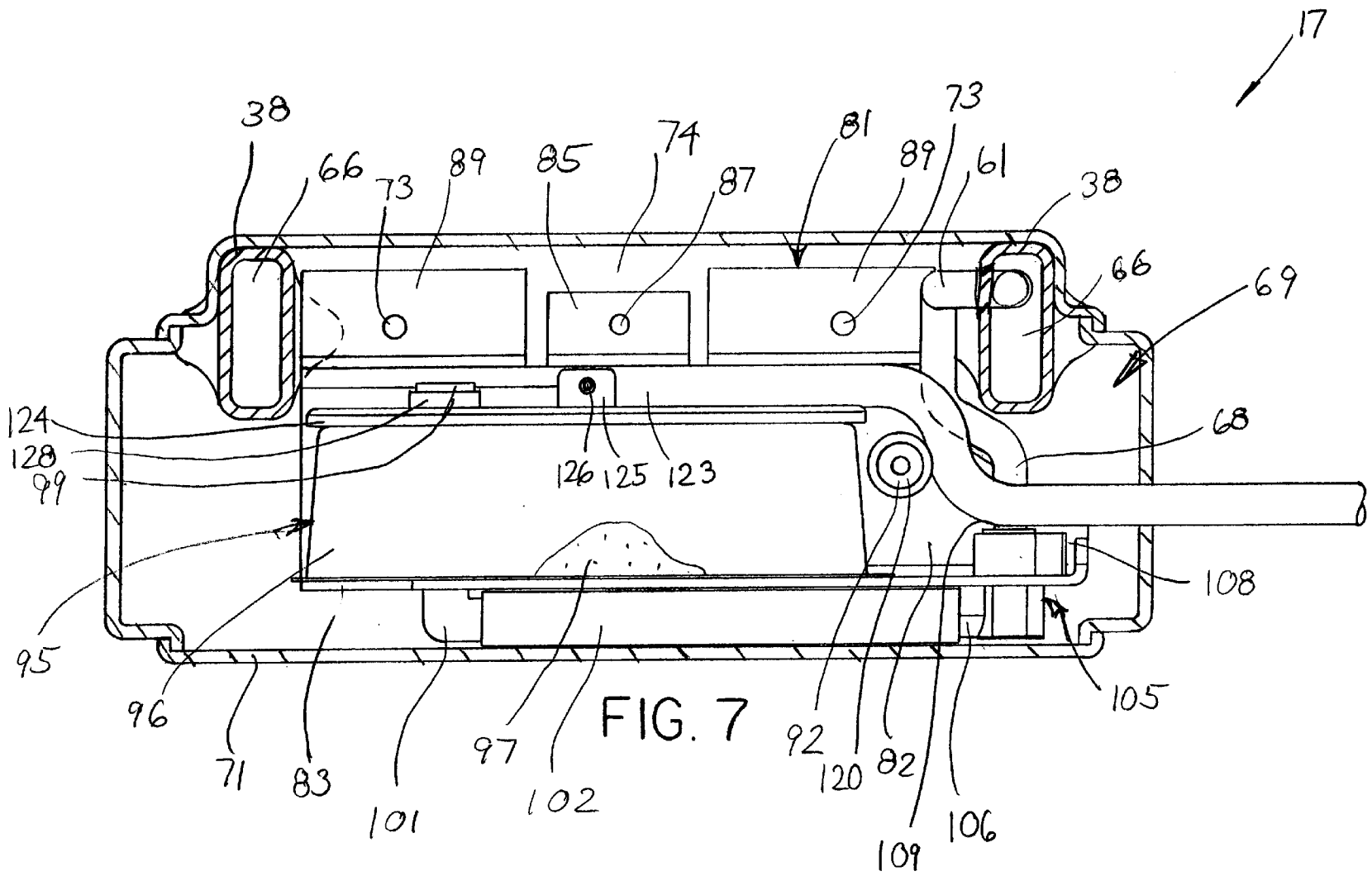
FIG. 7 is a rear elevational view of the pump unit in cross-section.
Figure 8:
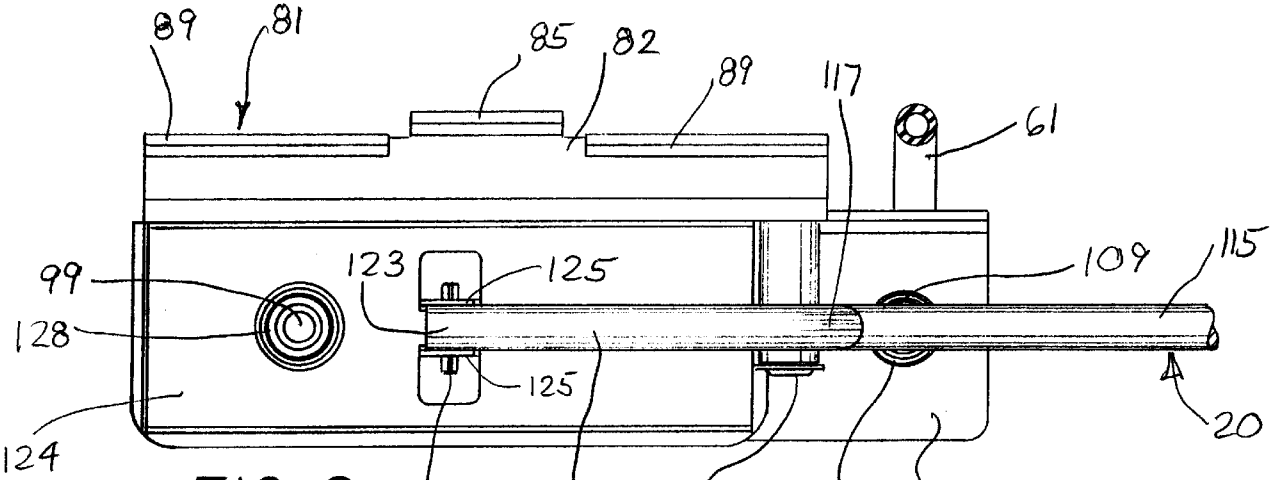
FIG. 8 is a plan view of the pump unit.

More particularly with respect to the pump unit 17 as seen in FIGS. 2, 3 and 7, the hollow interior 69 is defined by a hollow pump cover or housing 71 which is supported by a plate-like back wall 74 of the connector plate 36. The pump cover 71 has rearward opening bores 72 through which screws 73 are inserted to mount the pump cover 71 in place as will be described in greater detail herein.

The right side wall of the pump cover 71 also includes a handle opening 76 which is formed as a vertically elongate slot that opens upwardly so that the handle opening 76 can receive the handle 20 therein as the pump cover 71 is slid upwardly into position on the upright 34. Preferably, the pump cover 71 is formed of a plastic material that provides an aesthetically pleasing appearance for the pump unit 17.

As to the internal components of the pump unit 17 as illustrated in FIGS. 6–10, the pump unit 17 includes a rigid back plate 81 defined by a back wall 82 which extends vertically, and a bottom wall 83 which extends rearwardly from the lower edge of the back wall 82.

To mount the back plate 81 to the upright 36, the upper edge of the back wall 82 includes an upstanding central flange 85 which is stepped so as to be offset forwardly of the back plate wall 82. The central flange 85 includes a bore 86 extending forwardly therethrough and is adapted to lie against the back wall 74 of the upright 36. A fastener 87 (FIG. 7) is inserted forwardly through the bore 86 into threaded engagement with the back wall 74 to rigidly mount the back plate 81 on the upright 36 in a position disposed generally rearwardly of the control body 33.

Figure 6:
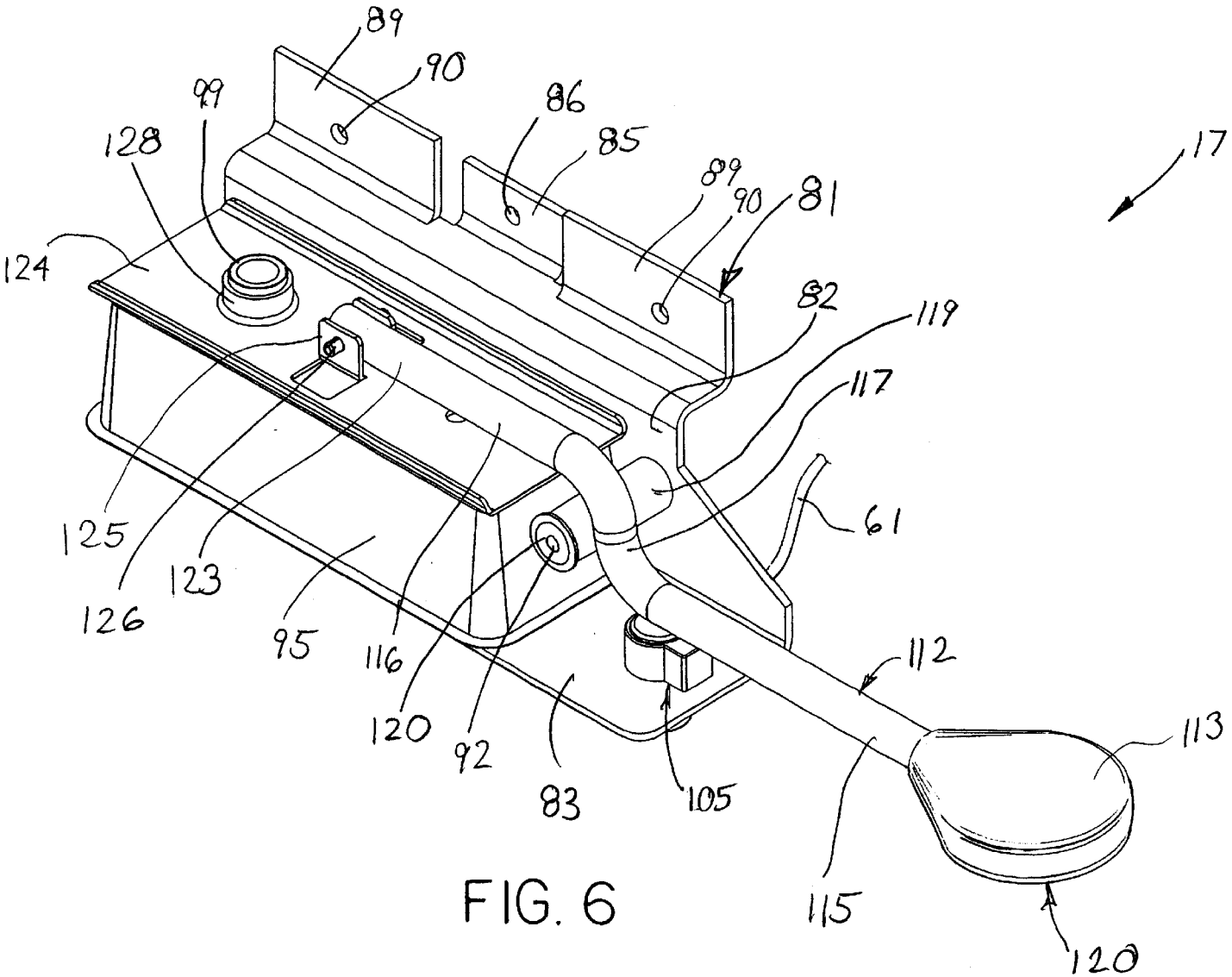
FIG. 6 is a rear perspective view of the internal components of the pump unit.
Figure 9:
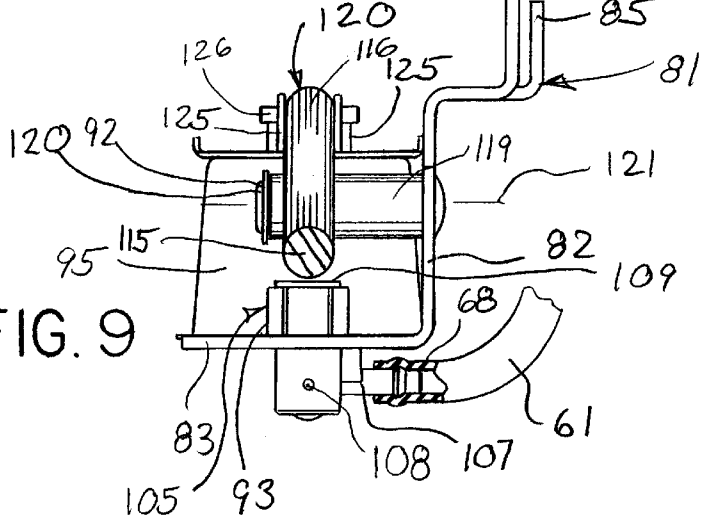
FIG. 9 is a side elevational view of the pump unit.

To support the pump cover 71 on the back plate 81, the back wall 82 also includes upstanding end flanges 89 which are offset rearwardly of the central flange 85 as seen in FIG. 9, which end flanges 89 include bores 90 as illustrated in FIG. 6. The bores 90 are adapted to receive the screws 73 forwardly therethrough so that the pump cover 71 is removably mounted on the back plate 81.

Figure 10:
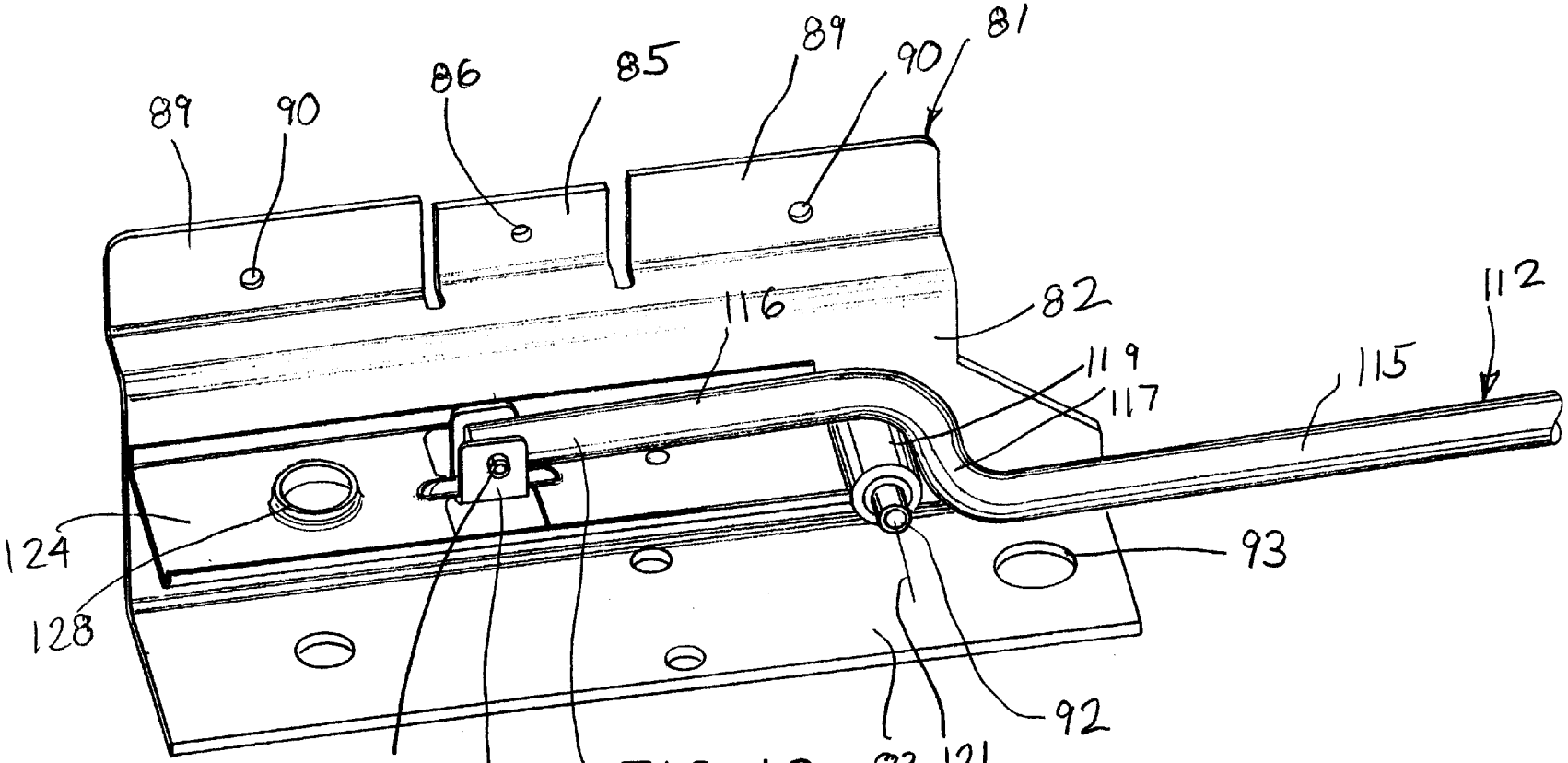
FIG. 10 is a rear perspective view of the actuator arrangement of the pump unit.

Additionally as seen in FIG. 10, the back wall 82 includes a cantilevered pivot mount 92 which projects rearwardly therefrom and is spaced upwardly of the bottom wall 83. The bottom wall 83 also includes a valve mount 93 which is offset sidewardly relative to the pivot mount 92 nearer to the right end of the back plate 81.

To provide for inflation of the bladder 14, the pivot unit 17 includes a pump 95 as seen in FIGS. 6–9 which is mounted on the top surface of the bottom wall 83 to the left of the pivot mount 92. The pump 95 preferably is a bellows pump defined by a compressible bellows 96 which preferably is formed of flexible urethane and has a resilient filler material 97 (FIG. 7 as seen in the cutaway section of the bellows 96). The filler material 97 preferably is a resiliently compressible and air-permeable foam.

The pump 95 also includes an intake valve 99 which is formed as a one-way check valve, and an outlet 100 that comprises a right-angle elbow 101 and a horizontal outlet tube 102 which extends horizontally below the bottom wall 83. The outlet tube 102 further includes a check valve which opens to permit pumped fluid to flow therethrough during a pump stroke but closes during a return stroke of the pump 95.

The filler material 97 is sufficiently compressible so as to permit compression of the bellows 96 during a pump stroke wherein the intake valve 99 remains closed while the outlet 100 permits fluid in the bellows 96, which is preferably air, to be pumped therethrough. At the same time, the filler material 97 is sufficiently resilient and porous such that during a return stroke, the filler material returns to its original uncompressed shape which also assists in expanding the bellows 96. During re-expansion of the bellows 96, the intake valve 99 opens to permit outside air to be drawn into the bellows 96 while the check valve in the outlet 102 prevents air from being drawn back in from the bladder 14.

The pump unit 17 further includes a fluid release valve 105 which is mounted to the valve mount 93. The release valve 105 projects downwardly through the bottom wall 83 and includes a valve inlet 106 (FIG. 7) that is connected to and is in fluid communication with the right end of the outlet tube 102. The release valve 105 also includes a valve outlet 107 (FIG. 9) which projects forwardly and is frictionally fitted to the lower distal end 68 of the fluid line 61.

In this arrangement, the release valve 105 is serially connected to the outlet tube 102 and to the lower end of the fluid line 61 through the valve inlet 106 and valve outlet 107 respectively. Therefore, during compression of the bellows 96, the fluid being pumped passes through the outlet tube 102 and then through the release valve 105 from the valve inlet 106 to the valve outlet 107. The fluid then flows from the valve outlet 107 into the fluid line 61 to thereby inflate the bellows 14. The check valve in the outlet tube 102 prevents back flow of the fluid and maintains the bellows 14 in an inflated state.

To deflate the bellows 14, the release valve 105 also includes a normally closed discharge port 108 as seen in FIG. 9 which is formed as a restricted orifice, and a spring-loaded actuator button 109 which faces upwardly. The actuator button 109 is operatively connected to the discharge port 108 such that when the actuator button 109 is pressed downwardly, the release valve 105 is opened to permit a gradual or controlled discharge of the fluid out of the fluid line 61. Since the check valve is present in the outlet 102, the fluid in the bladder 14 can only flow out of the discharge port 108.

To operate both the pump 95 and the release valve 105, the actuator handle 20 is pivotally connected to the back plate 81. In particular, the actuator handle 20 includes a horizontally elongate handle shaft 112 and a handgrip 113 on the outer end thereof.

The handle shaft 112 includes linear outer and inner sections 115 and 116 which are joined together by a generally S-shaped intermediate pivot section 117. The intermediate pivot section 117 has a tubular standoff 119 which is rigidly affixed to a bottom surface of the pivot section 117. The standoff 119 is oriented horizontally and is secured to the back plate 81 by the pivot mount 92, which pivot mount 92 extends horizontally through the standoff 119 and is supported on the back wall 82 of the back plate 81. The standoff 119 and pivot mount 92 are pivotally connected together by a fastener 120 so as to define a horizontal pivot axis 121. Accordingly, the handle shaft 112 is able to pivot in a vertical plane about the pivot axis 121.

To pivot the handle shaft 112, the outer shaft section 115, which is connected to the intermediate pivot section 117, extends outwardly away from the pivot axis 121 so that the handgrip 113 is accessible from an exterior of the chair 10. The outer shaft section 115 also is offset downwardly relative to the pivot axis 121 so as to be located directly above and abut against the actuator button 109 of the release valve 105. Accordingly, the outer shaft section 115 generally is disposed in a horizontal neutral position as illustrated in FIG. 6 whereby the release valve 105 is closed, but is pivotable downwardly through a release stroke to press the actuator button 109 and open the release valve 105. As such, the actuator handle 20 serves a first function of operating the release valve 105.

The actuator handle 20 also serves a second function of operating the pump 95. In this regard, the inner shaft section 116 extends inwardly away from the pivot axis 121 so as to overlie the bellows 96. In particular, the inner shaft section 116 is offset upwardly relative to the pivot axis 121 so that an inner end 123 of the inner shaft section 116 is disposed directly above a middle section of the bellows 96.

To effect pumping of the bellows 96, the inner shaft end 123 includes a horizontally enlarged compression plate 124 which has a generally rectangular shape that overlies the entire top surface of the bellows 96. The compression plate 124 includes upstanding connector flanges 125 which are pivotally connected to the inner shaft end 123 by a pivot pin 126 extending horizontally therethrough.

The compression plate 124 further includes an upward opening cylindrical valve seat 128 through which the intake valve 99 of the pump 95 extends. As a result, pivoting of the handle shaft 112 in a counterclockwise direction effects downward movement of the inner shaft section 116, which movement thereby operates the pump 95 by compressing the bellows 95 between the bottom wall 83 and the compression plate 124. This compression of the bellows 96 thereby pumps air through the pump outlet 100 to inflate the bladder 14. The bellows 96 can be returned to its uncompressed state via the resilient filler material 97 although, typically, the bladder 14 is inflated by moving the actuator handle 20 vertically toward and away from the neutral position through repeated pump strokes which movement is controlled manually by the chair occupant.

In operation, the actuator handle 20 is movable in opposite vertical directions to either inflate the bladder 14 or vent the fluid therein which deflates the bladder 14. More particularly, manual movement out of the actuator handle 20 upwardly away from the neutral position serves to compress the bladder 96 between the compression plate 124 and the bottom wall 83. This action pumps the fluid, namely air in the illustrated invention, out of the bladder 96. This pumped air flows through the outlet tube 102, the release valve 105 and the fluid line 61 to the bladder 14. By repeatedly moving the actuator handle 20 through the pump stroke, the bladder 14 can be selectively inflated to improve the comfort of the chair occupant.

Once inflated, however, it also is necessary to deflate the bladder 14 to adjust the inflation of the bladder 14 and possibly to completely vent the bladder 14. In this regard, the actuator handle 20 is moved downwardly in a clockwise direction away from the neutral position through a release stroke. This movement of the actuator handle 20 causes the outer shaft section 115 to press downwardly on the release button 109 to open the release valve 105. Thus, operation of the actuator button 109 opens the discharge port 108 to allow fluid to be vented or discharged therethrough.

This arrangement has the unique advantage of providing a single actuator to not only pump up the bladder 14 but also vent the fluid therefrom. The single actuator handle 20 thereby is movable in a first direction for pumping and a second direction for fluid release. While the actuator preferably is a pivoting lever which is moved vertically to be more conveniently accessible and usable by the chair occupant, the actuator also could be of an alternate structural arrangement that still provides bi-directional movement. For example, the actuator could be a slide mechanism whereby a slide moves in a first direction to actuate and compress a pump, and in a second direction to act on and open a release valve. In another construction, the actuator could have a rotary drive which operates the pump when moved in a first rotational direction and operates the release valve when moved in a second rotational direction.

Although a particular embodiment of the invention has been disclosed in detail for illustrative purposes, it will be recognized that variations or modifications of the disclosed apparatus, including the rearrangement of parts, lie within the scope of the present invention.

What is claimed is:

1. An office chair having an inflatable bladder arrangement, comprising:

a chair base;

an inflatable chair pad supported on said base which is disposed on one of a seat assembly and a back assembly and;

said inflatable bladder arrangement including a bladder which is positioned in said chair pad, and a pump unit connected to said bladder, said pump unit having a bellows pump which pumps fluid into said bladder to inflate said bladder and having a release valve which releases said fluid to deflate said bladder, said inflatable bladder arrangement further including a manually movable actuator member which is supported on said chair and is connected to said pump and said release valve, said actuator member being movable in a first direction from a neutral position to actuate said pump and inflate said bladder and being movable in a second direction to actuate said release valve and deflate said bladder, said actuator member being accessible from an exterior of said chair for manual movement thereof in said first and second directions, said bellows pump comprising an outer bellows material defining a hollow interior and a filler material in said hollow interior which is air-permeable and resilient to maintain and restore said bellows material to an uncompressed shape and return said actuator member to said neutral position.

2. The chair according to claim 1, wherein said actuator member is moved repeatedly in said first direction to actuate said pump, and is moved through a single stroke in said second direction to actuate said release valve.

3. The chair according to claim 2, wherein said actuator member is movable vertically.

4. The chair according to claim 1, wherein said chair pad is disposed in said back assembly and said actuator member is a lever pivotally connected to said chair base below said seat assembly by a pivot connection which defines a pivot axis, said lever having an outer section which is accessible from the exterior of the chair for manual pivoting thereof, said lever having inwardly of said outer section a first section which cooperates with said pump and a second section which cooperates with said release valve, said first and second sections being movable to operate said pump when said lever is pivoted in said first direction and to operate said release valve when said lever is pivoted in said second direction.

5. The chair according to claim 4, wherein said release valve includes a discharge port through which said fluid is vented and a valve button which opens and closes said discharge port, said discharge port being normally closed and said valve button being operated by said second section of said lever for opening said discharge port.

6. The chair according to claim 4, wherein said first and second sections are disposed on opposite sides of said pivot axis such that pivoting of said actuator lever effects movement of said first and second portions in the same direction.

7. The chair according to claim 1, wherein said fluid is air and said pump has an inlet for receiving air therein, said pump further having a pump outlet connected to an air line which extends from said pump to said bladder for pumping said air therein.

8. The chair according to claim 7, wherein said release valve is serially connected to said air line and permits passage of said air therethrough, said release valve including a normally closed discharge port and a valve button which is actuated by said actuator member to open said discharge port.

9. An office chair having an inflatable bladder arrangement, comprising:

a chair base;

a chair pad supported on said base which is provided on one of a seat assembly and a back assembly and;

said inflatable bladder arrangement including a bladder which is positioned in said chair pad and a pump unit connected to said bladder, said pump unit being removably mounted to an exterior of said seat assembly below a top surface of said seat assembly, said pump unit having a pump which is in fluid communication with said bladder and pumps fluid into said bladder for inflation thereof, and a normally closed release valve which is in fluid communication with said bladder to permit release of said fluid from said bladder, said inflatable bladder arrangement further including a manually movable actuator lever which is pivotally supported on said chair base by a pivot connection which defines a pivot axis about which said actuator lever pivots, said actuator lever having an inner section which cooperates with said pump and said release valve, and an outer section which is accessible from an exterior of said chair for pivoting movement thereof, said actuator lever normally being in a neutral position and being movable away from said neutral position in a first direction to actuate said pump and inflate said bladder and in a second direction to open said release valve and deflate said bladder.

10. The chair according to claim 9, wherein said pump is connected to said bladder by an air line extending therebetween, said release valve being connected in series to said air line and having a normally closed discharge port which is openable by movement of said actuator lever in said second direction.

11. The chair according to claim 10, wherein said chair includes a rigid tubular upright which connects said back assembly to said chair base, said bladder being disposed on said back assembly and said pump unit being disposed on said chair base wherein said air line extends therebetween through said upright.

12. The chair according to claim 10, wherein said release valve has a movable valve button which is connected to said actuator lever so that movement of said actuator lever in said second direction moves said valve button to open said discharge port.

13. The chair according to claim 9, wherein said pump is a bellows pump having a resilient member which resists compression of said bellows pump and biases said actuator lever to said neutral position.

14. The chair according to claim 9, wherein said pivot axis extends generally horizontally so that said actuator lever pivots vertically about said horizontal pivot axis and said first and second directions extend vertically away from each other.

15. The chair according to claim 14, wherein said pump and said release valve are disposed in side-by-side relation and said actuator lever has first and second portions which cooperate respectively with said pump and said release valve, said first and second portions being disposed on opposite sides of said pivot axis so that said first and second portions of said actuator lever move in the same vertical direction.

16. An office chair having an inflatable bladder arrangement, comprising:

a chair base which extends upwardly;

an L-shaped seat-back arrangement comprising a horizontally enlarged seat assembly which is supported on an upper end of said chair base, and a vertically enlarged back assembly which projects upwardly from a rear edge of said seat assembly and is connected to said seat assembly by a rigid upright;

said inflatable bladder arrangement including a bladder positioned in said seat-back arrangement, a pump unit supported on said seat assembly, and a fluid line connecting said bladder and said pump unit in fluid communication to permit pumping of a fluid from said pump unit to said bladder for inflation thereof, said pump unit comprising a pump supported on said seat assembly and an actuator handle pivotally supported on said seat assembly, said actuator handle having an inner end operatively connected to said pump and an outer end which is disposed below said seat assembly and projects sidewardly therefrom to permit an occupant seated in said chair to reach downwardly to the side of said chair and pivot said actuator handle, said actuator handle further including a hand grip on the outer end thereof which permits repeated pivoting movement of said actuator handle through a pump stroke to actuate said pump and pump fluid into said bladder.

17. The chair according to claim 16, wherein said bladder is disposed in said back assembly and said fluid line extends along said upright.

18. The chair according to claim 17, wherein said upright is hollow to define a passage extending therethrough wherein said fluid line extends through said passage.

19. The chair according to claim 16, wherein said pump unit includes a release valve which is in fluid communication with said fluid line and is connected to said actuator handle such that pivoting movement of said actuator handle opens said release valve to permit deflation of said bladder.

20. The chair according to claim 16, wherein said pump unit includes a pump cover which encloses said pump and is connected to said seat assembly adjacent said rear edge, said pump cover defining an exposed surface of said chair.

21. The chair according to claim 16, wherein said pump unit is removably mounted to an exterior of said seat assembly below a top surface of seat assembly via fasteners.

22. The chair according to claim 16, wherein said pump is a bellows pump comprising an airtight outer bellows material defining a hollow interior and a filler material disposed in said hollow interior, said filler material being air-permeable to permit air to be stored within said bellows material in an uncompressed shape and being resilient to maintain and restore said bellows material to said uncompressed shape.

23. The chair according to claim 16, wherein said inner end of said actuator handle has a compression plate which overlies and is sized to contact a face of said pump, said compression plate being pivotally connected to and supported solely on said inner end.

* * * * *